US009003680B2

(12) United States Patent
Lee

(10) Patent No.: US 9,003,680 B2
(45) Date of Patent: Apr. 14, 2015

(54) DISCHARGE PIPE FOR SNOW BLOWER

(75) Inventor: Jang Yong Lee, Gyeonggi-do (KR)

(73) Assignee: Korea Institute of Industrial Technology, Chungcheongnam-do (KR)

( * ) Notice: Subject to any disclaimer, the term of this patent is extended or adjusted under 35 U.S.C. 154(b) by 0 days.

(21) Appl. No.: 13/811,888

(22) PCT Filed: Dec. 28, 2011

(86) PCT No.: PCT/KR2011/010191
§ 371 (c)(1),
(2), (4) Date: Jan. 23, 2013

(87) PCT Pub. No.: WO2013/035942
PCT Pub. Date: Mar. 14, 2013

(65) Prior Publication Data

US 2014/0059899 A1 Mar. 6, 2014

(30) Foreign Application Priority Data

Sep. 7, 2011 (KR) ..... 10-2011-0090851

(51) Int. Cl.
*E01H 5/09* (2006.01)
*E01H 5/04* (2006.01)

(52) U.S. Cl.
CPC ..... *E01H 5/045* (2013.01)

(58) Field of Classification Search
USPC ..... 37/251, 260, 261; 406/158
See application file for complete search history.

(56) References Cited

U.S. PATENT DOCUMENTS

| | | | | | |
|---|---|---|---|---|---|
| 2,605,561 | A | * | 8/1952 | Maynard et al. | 37/259 |
| 2,768,453 | A | * | 10/1956 | Adams, Jr. | 37/252 |
| 2,836,021 | A | * | 5/1958 | Wood et al. | 56/13.4 |
| 2,858,625 | A | * | 11/1958 | Rivinius | 37/256 |
| 2,971,279 | A | * | 2/1961 | Hilaire Blanchet | 37/256 |
| 3,075,813 | A | * | 1/1963 | Vohl | 406/158 |
| 3,088,779 | A | * | 5/1963 | Vachon | 406/158 |
| 3,363,345 | A | * | 1/1968 | Ober | 37/252 |
| 3,483,960 | A | * | 12/1969 | Burke et al. | 198/522 |
| 3,532,245 | A | * | 10/1970 | Gielow et al. | 220/478 |
| 3,580,351 | A | * | 5/1971 | Mollen | 180/53.7 |
| 3,913,247 | A | * | 10/1975 | Ruhl | 37/258 |
| 4,071,966 | A | * | 2/1978 | Cohen | 37/228 |
| 4,404,762 | A | | 9/1983 | Munsterer | |
| 4,951,403 | A | * | 8/1990 | Olmr | 37/262 |
| 5,315,771 | A | * | 5/1994 | White et al. | 37/260 |
| 5,438,770 | A | * | 8/1995 | Miller | 37/227 |
| 5,735,064 | A | * | 4/1998 | Holl | 37/260 |
| 6,568,106 | B2 | * | 5/2003 | Takeuchi | 37/262 |
| 6,684,535 | B2 | * | 2/2004 | Hancock et al. | 37/260 |
| 7,032,333 | B2 | * | 4/2006 | Friberg et al. | 37/260 |
| 7,347,013 | B2 | * | 3/2008 | Deschler et al. | 37/260 |
| 7,472,500 | B2 | * | 1/2009 | White, III | 37/262 |
| 7,540,102 | B2 | | 6/2009 | Olmr et al. | |

FOREIGN PATENT DOCUMENTS

| | | |
|---|---|---|
| JP | 10-008431 A | 1/1998 |
| KR | 97-39402 | 7/1997 |

* cited by examiner

*Primary Examiner* — Jamie L McGowan
(74) *Attorney, Agent, or Firm* — Reinhart Boerner Van Deuren P.C.

(57) ABSTRACT

Provided is a discharge pipe for a snow blower, which is mounted on the snow blower, and is capable of easily removing snow covered on an inner wall of a conveyance duct in the process of discharging snow introduced from the snow blower to the outside.

4 Claims, 11 Drawing Sheets

(a)

(b)

DISCHARGE PIPE FOR SNOW BLOWER

TECHNICAL FIELD

The present invention relates, in general, to a snow blower, and more particularly, to a discharge pipe for a snow blower, which is mounted on the snow blower and is capable of easily removing snow covered on an inner wall of a conveyance duct in the process of discharging snow introduced from the snow blower to the outside.

BACKGROUND ART

When snow piled on a principal road cannot be timely removed due to difficult access of a dedicated snowplow or a shortage of the number of dedicated snowplows, or when snow is required to be removed from an area such as a farmhouse, a farm road, or a town road for its own sake, the snow is removed using a tractor sent to the area.

For this reason, the related art employs a method of mounting a snow blower operated in a blowing manner on a tractor and blowing off snow to the outside of a road or a road surface through a discharge pipe installed on the snow blower.

In detail, as shown in FIGS. 1 and 2, the conventional snow blower includes a body having means for mounting the snow blower 10 in the front of a tractor 1 or a dedicated snow-removing vehicle, a blade 20 formed at a lower portion of the body in a semi-cylindrical structure and scraping snow together in contact with a road surface, an auger 30 installed in the blade and compressing and conveying the snow introduced into the blade to an impeller suction passage formed in the center of the blade, and an impeller 25 receiving the snow conveyed by the auger and blowing the snow off to the outside through a discharge pipe 35.

This snow blower employs a method of blowing off the snow introduced into the discharge pipe by the auger and the impeller to the outside. The discharge pipe is configured to have a predetermined length, and includes a cover 40 whose upper side is coupled so as to be inclined from the discharge pipe at a predetermined angle in order to stably discharge the laterally introduced snow.

Thus, there occurs a phenomenon that the snow introduced into the discharge pipe by the impeller moves along the discharge pipe directly in an upward direction, runs into an inner side of the cover 40 coupled on the upper side of the discharge pipe so as to be inclined at a predetermined angle, and is piled up there.

In this way, the snow piled up on the inner wall of the cover reduces an inner diameter of the cover, which causes obstruction to conveyance of the snow. As such, the conveyance efficiency of the snow is lowered.

DISCLOSURE

Technical Problem

Accordingly, the present invention has been made keeping in mind the above problems occurring in the related art, and an object of the present invention is to provide a discharge pipe for a snow blower, in which a scraper is provided on the side of an outlet thereof, and a cover plate whose lower surface is in contact with the scraper is movably coupled on the side of the outlet thereof, so that the cover plate is displaced to be able to easily remove the covered snow through the scraper although the snow discharged to the outside through the inside is piled up on the lower surface of the cover plate.

Technical Solution

In order to achieve the above object, there is provided a discharge pipe for a snow blower, which is mounted on the snow blower and discharges snow introduced inwards to the outside. The discharge pipe includes: a box-shaped body having an inlet and an outlet through which the snow is introduced and discharged and an opening in an upper portion thereof at a side of the outlet; a cover plate having a predetermined area and slidably coupled to the body so as to cover the opening; and a scraper having a shape of a bar having a predetermined length and disposed on the side of the outlet so as to come into line or surface contact with a lower surface of the cover plate. When the cover plate slides toward the outlet, the snow covered on the lower surface of the cover plate is removed by the scraper.

Preferably, the cover plate further includes a handle on an upper surface thereof.

Preferably, the cover plate includes hooks extending downwards from opposite ends thereof to a predetermined length, and the body includes guide grooves cut in a direction parallel to a discharging direction of the snow to a predetermined depth so that the hooks can slide along the guide grooves.

Preferably, the body includes at least one driving motor, to a rotational shaft of which a driving gear is coupled, on the side of the outlet, and the cover plate includes a driven gear, with which the driving gear is meshed, on the lower surface thereof.

Preferably, the body includes at least one driving motor, to a rotational shaft of which a driving gear is coupled, fixedly supported on one side thereof via a bracket, and the cover plate includes a driven gear, with which the driving gear is meshed, on an upper surface thereof.

Advantageous Effects

According to the present invention, the cover plate whose lower surface is in contact with the scraper is movably coupled on the side of the outlet of the discharge pipe. Thereby, although the snow discharged to the outside through the inside is piled up on the lower surface of the cover plate, the cover plate is displaced to be able to easily remove the covered snow through the scraper. Thus, the efficiency of the snow-removing work can be increased.

MODE FOR INVENTION

Figure 1:
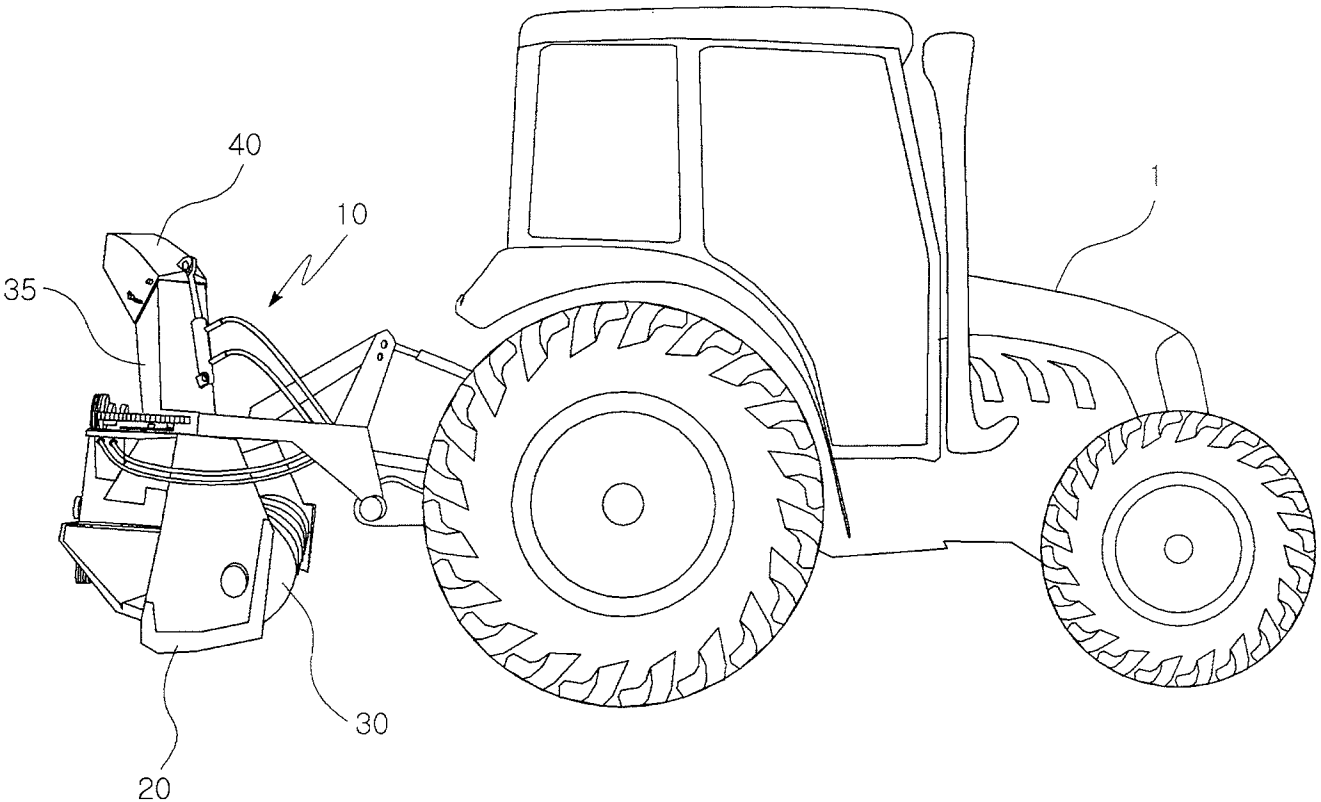
FIG. 1 shows a state in which a conventional snowplow is mounted on a tractor.
Figure 2:
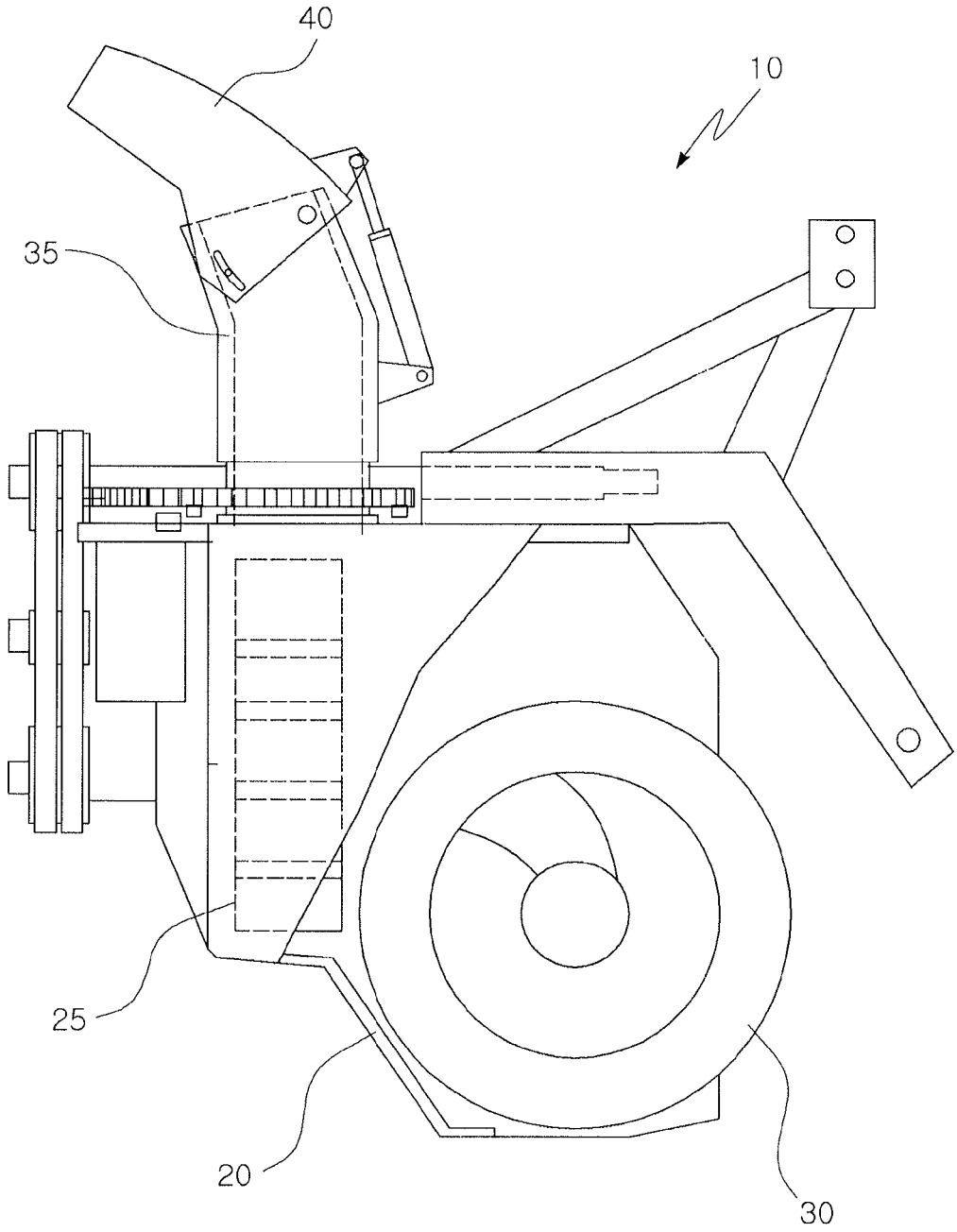
FIG. 2 is a partial side cross-sectional view showing a configuration of the snowplow of FIG. 1.
Figure 3:
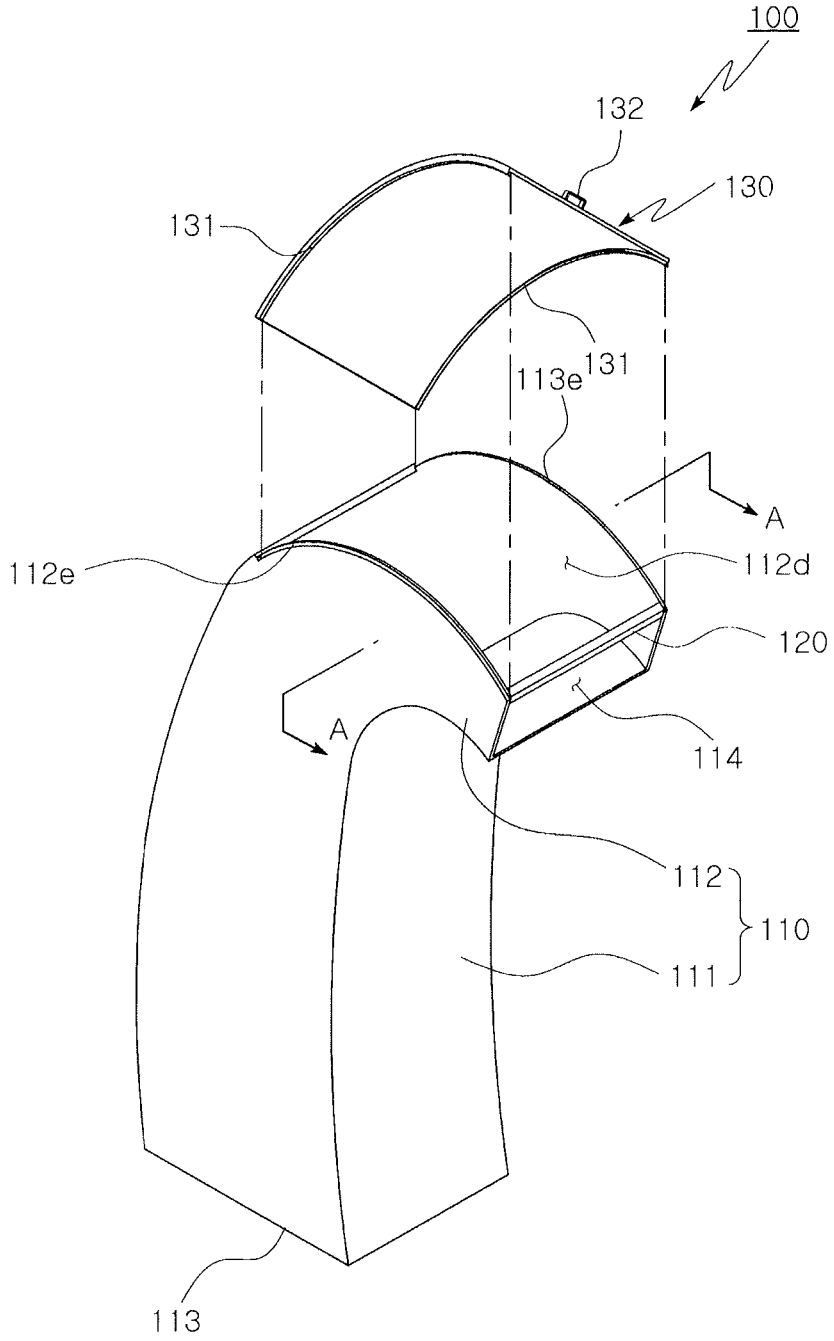
FIG. 3 is a disassembled perspective view showing a discharge pipe for a snow blower according to a first embodiment of the present invention.

Reference will now be made in greater detail to an exemplary embodiment of the invention with reference to the accompanying drawings.

Hereinafter, to help understanding of the present invention, the same reference numbers will be used for the same components although they are indicated in different drawings.

A discharge pipe 100, 200, or 300 for a snow blower according to an exemplary embodiment of the present invention (hereinbelow, referred to simply as "discharge pipe") is mounted on the snow blower, and functions as a conveyance duct for blowing off snow introduced from the snow blower to the outside. The discharge pipe 100, 200, or 300 is configured so that a scraper 120 is installed on the side of an outlet 114 through which snow is discharged, and so that a cover plate 130, 230, or 330 whose lower surface is in contact with the scraper 120 is slidably coupled to a body 110. Thus, the discharge pipe 100, 200, or 300 has a technical feature in that the cover plate 130, 230, or 330 slides to allow the scraper 120 to easily remove snow piled up on the lower surface of the cover plate 130, 230, or 330.

As shown in FIGS. 3 to 11, the discharge pipe 100, 200, or 300 includes the body 110, the cover plate 130, 230, or 330, and the scraper 120.

The body 110 is mounted on a typically used snow blower 10, and serves as a conveyance duct that guides snow conveyed through an auger 30 and an impeller 25 to the side of a road or a road surface. The body 110 is provided with an inlet 113 and an outlet 114 on opposite ends thereof, and thus has the shape of a hollow box having a predetermined length.

The inlet 113 is mounted on the side of the snow blower 10 so as to allow snow moving upward through the auger 30 and the impeller 25 to be introduced into the body 110.

Further, the body 110 is made up of a first body 111 that has a predetermined height in a direction perpendicular to the ground so as to allow the snow introduced through the inlet 113 to move upwards, and a second body 112 that is bent in a direction perpendicular to the first body 111 at a predetermined angle and that includes an outlet 114 so as to allow the snow conveyed upwards through the first body 111 to be guided and discharged to the side of a road or a road surface.

Thus, the snow introduced through the inlet 113 moves upwards along the first body 111, and then is discharged to the outside through the outlet 114 of the second body 112. In this process, since the second body 112 is bent relative to the first body 111 at a predetermined angle, the snow conveyed along the first body 111 moves toward the outlet 114, runs into the side of an upper portion of the second body 112, and is deposited in part.

While the snow is discharged to the outside through the outlet 114 in this way, the snow covered on an inner surface of the body 110 should be easily removed and efficiently discharged. To this end, in the present invention, the second body 112 is provided with an opening 112*d* on the upper portion side thereof, and the separate cover plate 130, 230, or 330 is slidably coupled to the opening 112*d*.

Thereby, when the snow is covered on the lower surface of the cover plate 130, 230, or 330 formed on the upper portion side of the second body 112, the cover plate 130, 230, or 330 is displaced to easily remove the snow covered on the lower surface of the cover plate 130, 230, or 330 by the aid of the scraper 120 so as to increase the conveyance efficiency of the snow moving into the body 110.

To this end, as shown in FIGS. 3, 4, 6, 7, 10, and 11, the second body 112 includes a bottom part 112*a* having a predetermined area, and opposite sidewalls 112*b* and 112*c* extending upwards from opposite ends of the bottom part 112*a* to a predetermined height, and thus is configured so that front, rear, and upper portions thereof are open.

Thus, the open front portion is spatially connected with an upper end of the first body 111, and the open rear portion is formed as the outlet 114 through which the conveyed snow is discharged. Further, the open upper portion is coupled and covered with the cover plate 130, 230, or 330. Thereby, the snow conveyed through the first body 111 moves toward the outlet 114 so as to be able to be discharged to the outside only through the outlet 114.

Figure 5:
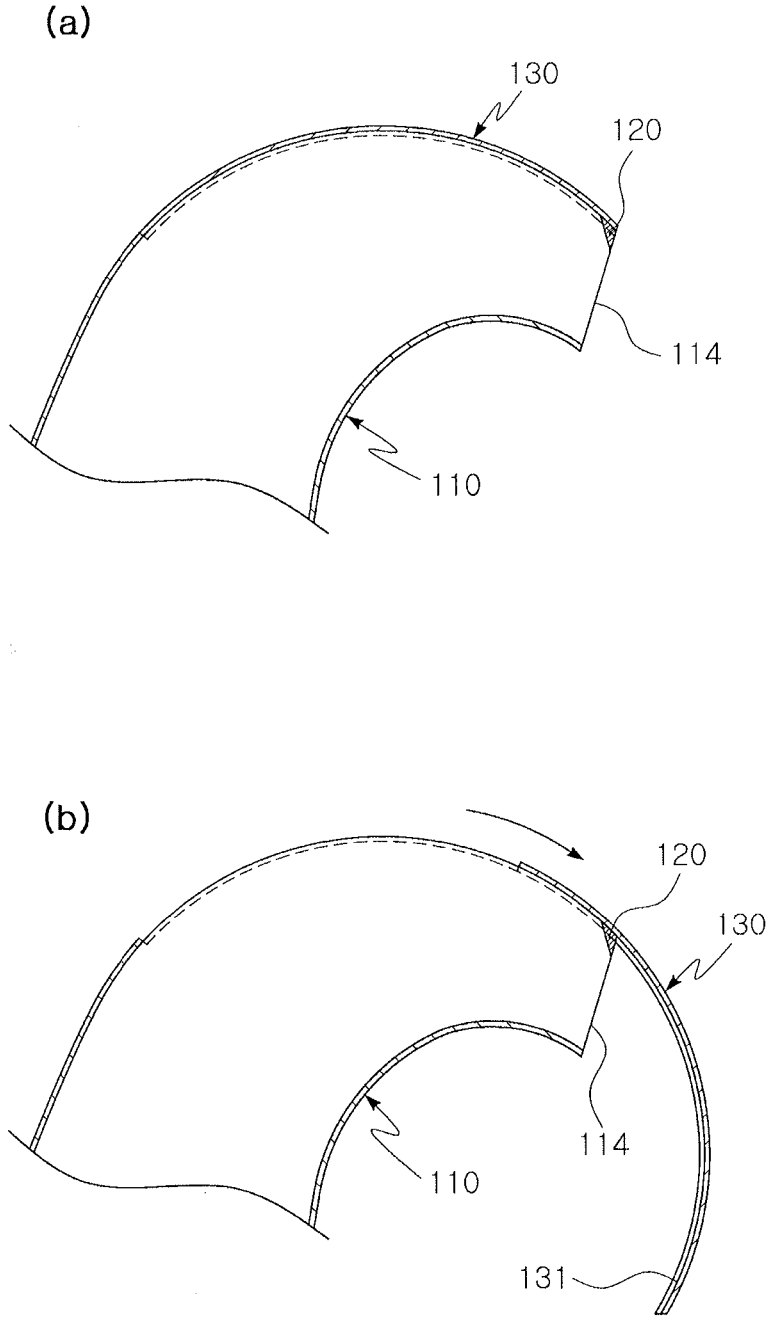
FIG. 5 is a cross-sectional view taken along line B-B of FIG. 4 in order to show an operation of the discharge pipe for the snow blower according to the first embodiment of the present invention.
Figure 8:
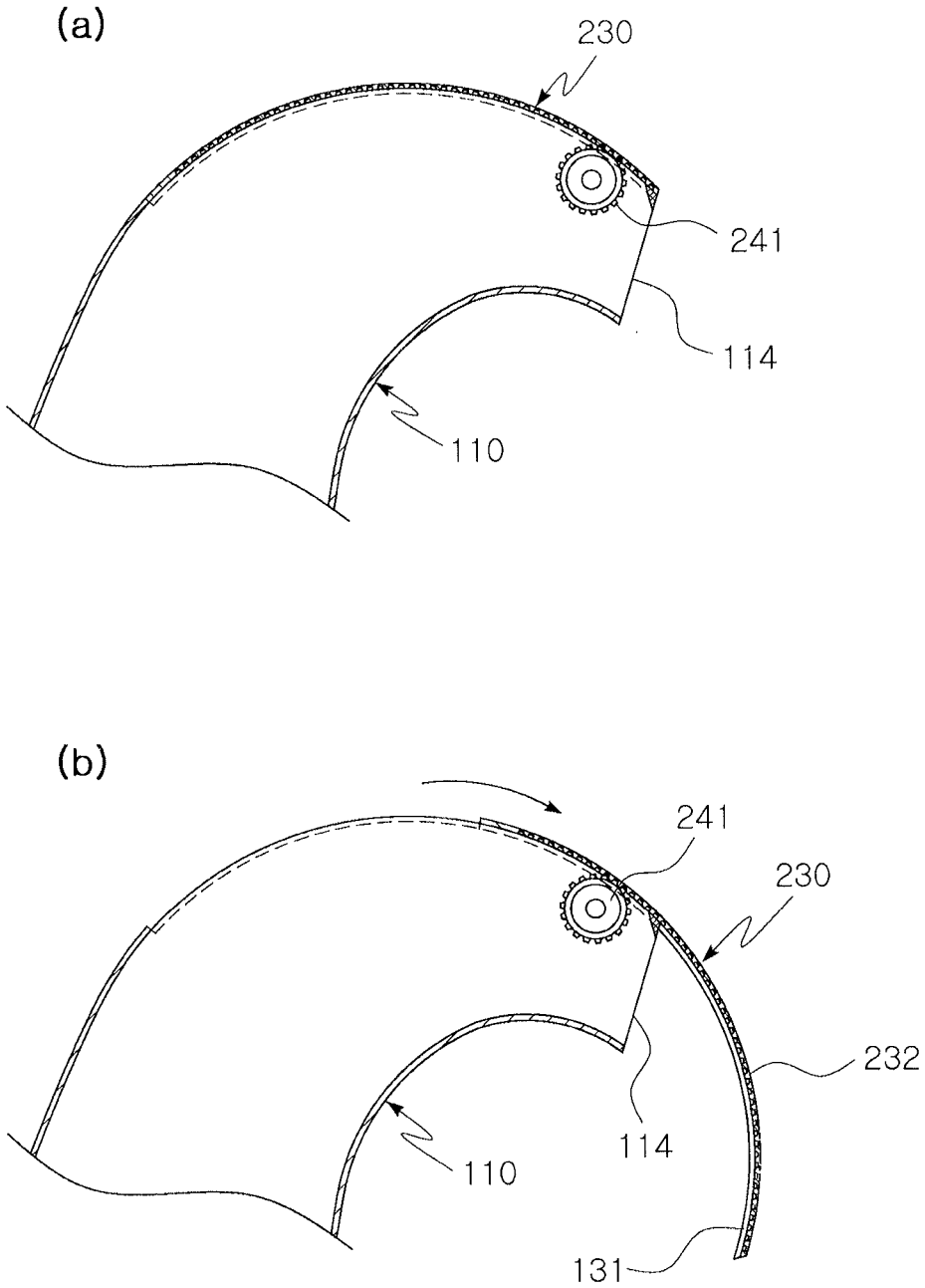
FIG. 8 is a cross-sectional view taken along line B-B of FIG. 7 in order to show an operation of the discharge pipe for the snow blower according to the second embodiment of the present invention.
Figure 11:
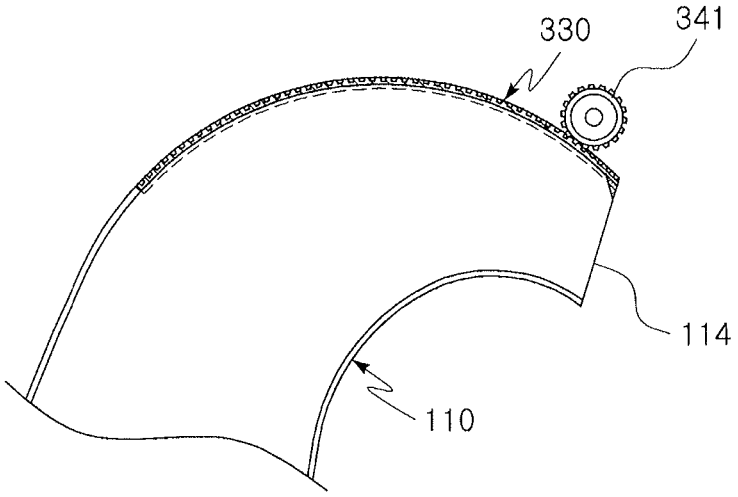
FIG. 11 is a cross-sectional view taken along line B-B of FIG. 10 in order to show an operation of the discharge pipe for the snow blower according to the third embodiment of the present invention.
Figure 11:
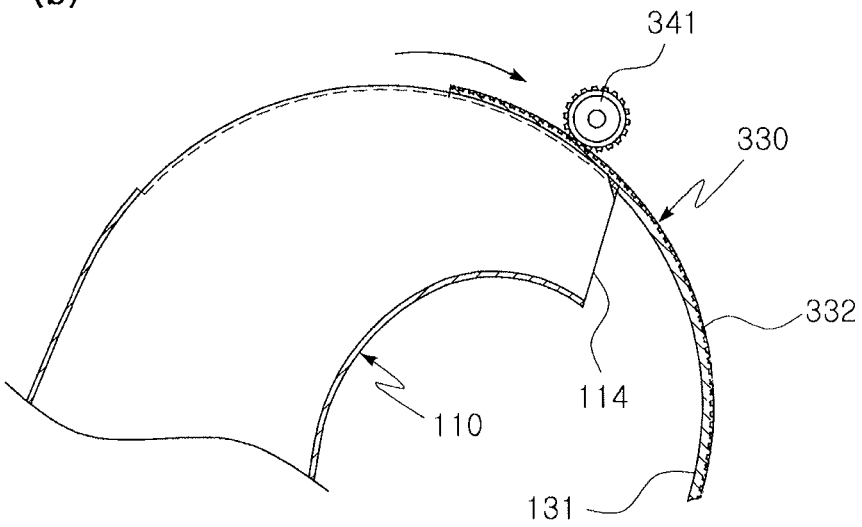

Here, the scraper 120 of a bar shape which mutually connects upper ends of the opposite sidewalls 112*b* and 112*c* extending upwards from the opposite ends of the bottom part 112*a* to a predetermined height is provided to the outlet 114. The scraper 120 is disposed on the side of the outlet 114 so as to come into contact with the lower surface of the cover plate 130, 230, or 330, and serves to remove the snow covered on the lower surface of the cover plate 130, 230, or 330 when the cover plate 130, 230, or 330 moves toward the outlet 114, as shown in FIGS. 5, 8, and 11.

This scraper 120 may be provided so as to have a circular or polygonal cross-section. However, as shown in FIGS. 5, 8, and 11, the scraper 120 is preferably provided so as to have an inverse triangular cross-section so that it can effectively remove the snow covered on the lower surface of the cover plate 130, 230, or 330.

Figure 4:
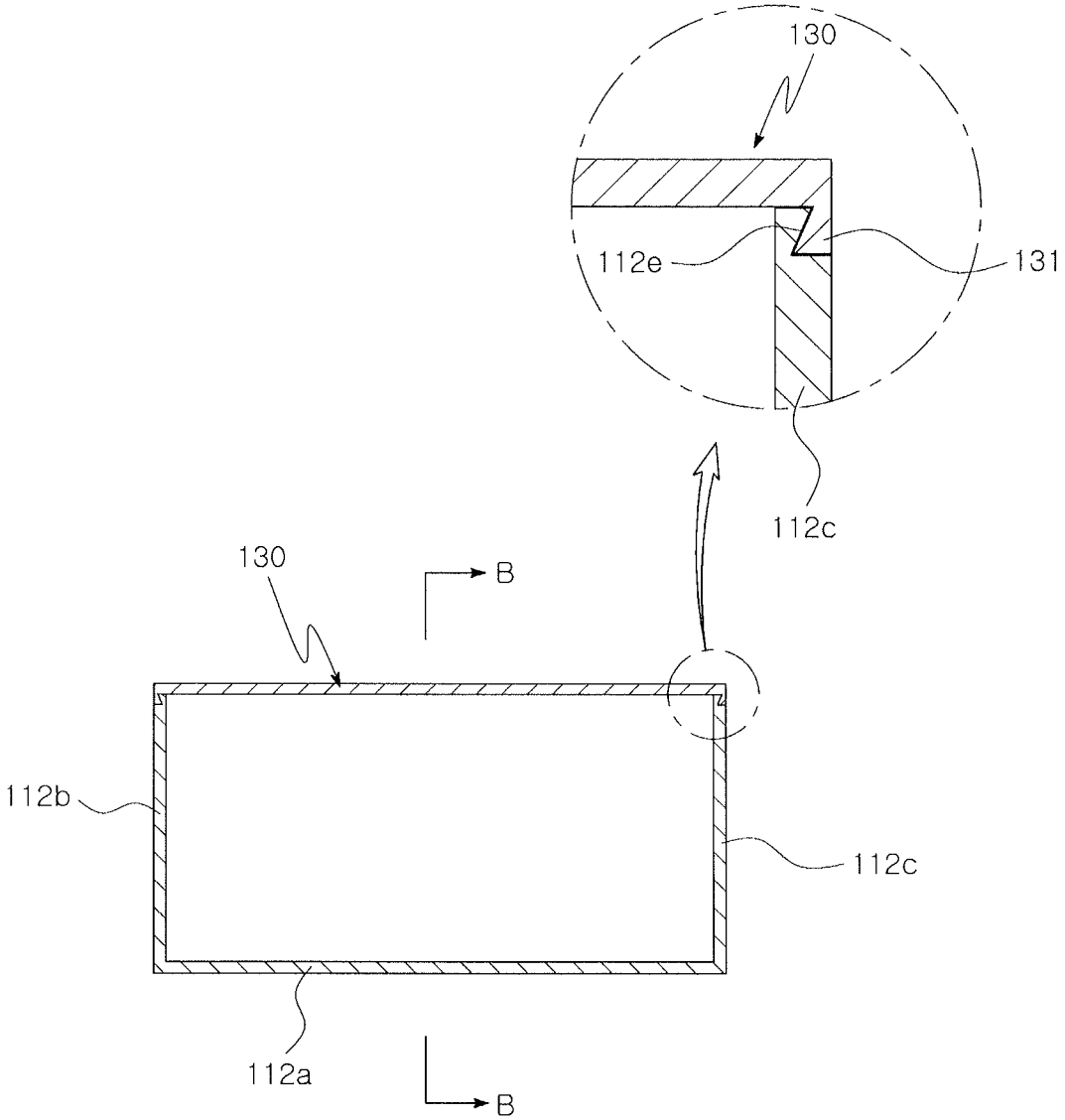
FIG. 4 is a longitudinal cross-sectional view taken along line A-A of FIG. 3 in order to show a coupled relation of the cover plate.
Figure 7:
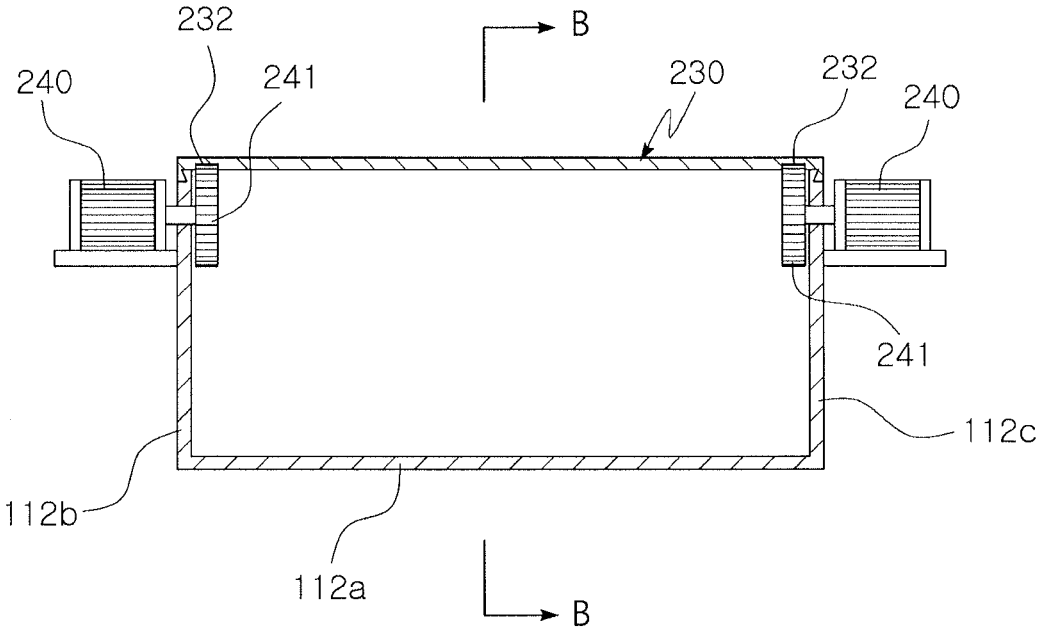
FIG. 7 is a longitudinal cross-sectional view taken along line A-A of FIG. 6 in order to show a coupled relation of the cover plate.
Figure 10:
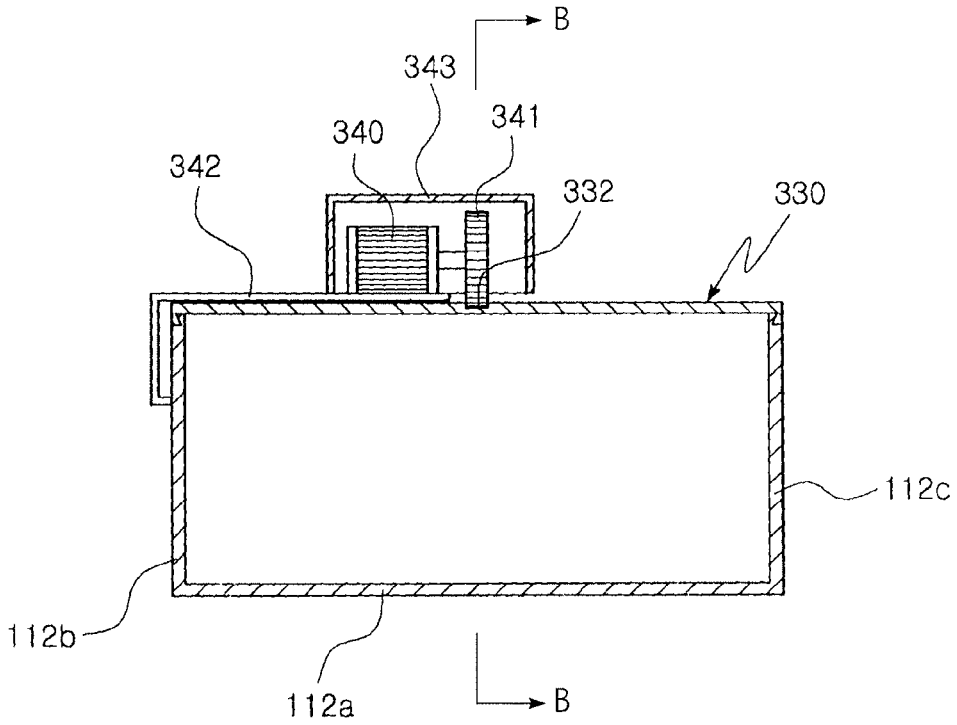
FIG. 10 is a longitudinal cross-sectional view taken along line A-A of FIG. 9 in order to show a coupled relation of the cover plate.

Meanwhile, the cover plate 130, 230, or 330 covering the open upper portion, i.e. the opening 112*d*, of the second body 112 is slidably coupled to upper portions of the opposite sidewalls 112*b* and 112*c*. To this end, as shown in FIGS. 4, 7 and 10, the cover plate 130, 230, or 330 is provided with hooks 131 extending downwards from opposite ends thereof which are coupled to the opposite sidewalls 112*b* and 112*c* to a predetermined length, and the upper ends of the opposite sidewalls 112*b* and 112*c* are provided with guide grooves 112*e* cut from the outside toward the inside to a predetermined depth so as to be positively fitted with the hooks 131.

Accordingly, when the snow is piled up on the lower surface of the cover plate 130, 230, or 330 in the snow-removing process, and thus the process of discharging the snow through the outlet 114 is obstructed, a worker slides the cover plate 130, 230, or 330 toward the outlet 114. Then, the lower surface of the cover plate 130, 230, or 330 slides in contact with the scraper 120 in the moving process. Due to this contact, the snow piled up on the lower surface of the cover plate 130, 230, or 330 is separated from the lower surface of the cover plate 130, 230, or 330, and the worker then returns the cover plate 130, 230, or 330 back to the original state. Thereby, the snow-removing work can be continuously performed.

Here, an upper surface of the cover plate 130 is preferably provided with a handle 132 so as to enable the worker to easily slide the cover plate 130.

Meanwhile, as shown in FIGS. 6 to 11, the cover plate 230 or 330 is allowed to automatically slide using at least one driving motor 240.

Figure 6:
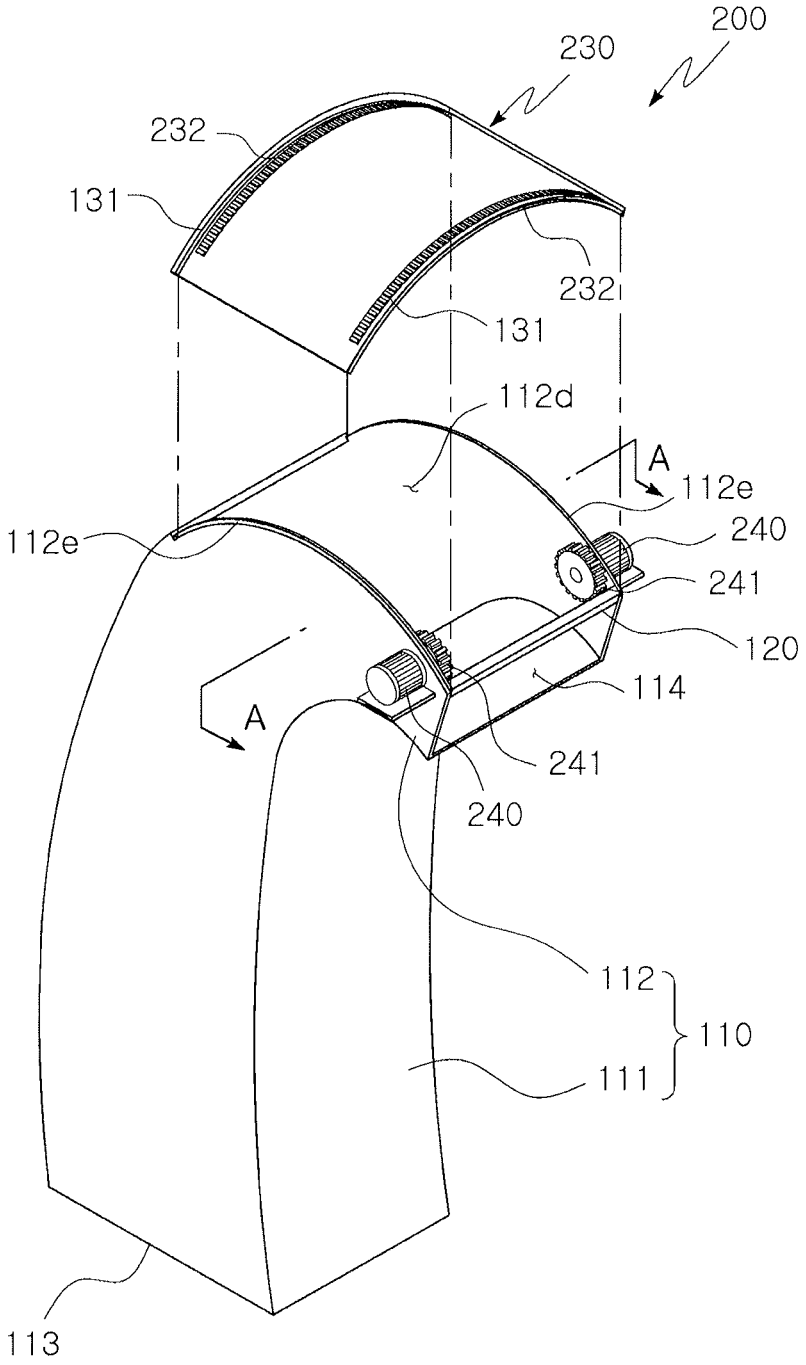
FIG. 6 is a disassembled perspective view showing a discharge pipe for a snow blower according to a second embodiment of the present invention.

In detail, as shown in FIGS. 6 to 8, driving motors 240, to rotational shafts of which driving gears 241 are coupled, are fixedly installed on the opposite sidewalls 112*b* and 112*c* of the second body 112, and driven gears 232 are formed in the lower surface of the cover plate 230 so as to be able to mesh with the driving gears 241. As a result, when the driving motors 240 are powered, a driving force is transmitted to the driven gears 232 meshed with the driving gears 240 by forward or backward rotation of the driving gears 241. Thereby, the cover plate 230 slides along the guide grooves 112*e* formed in the opposite sidewalls 112*b* and 112*c*.

Figure 9:
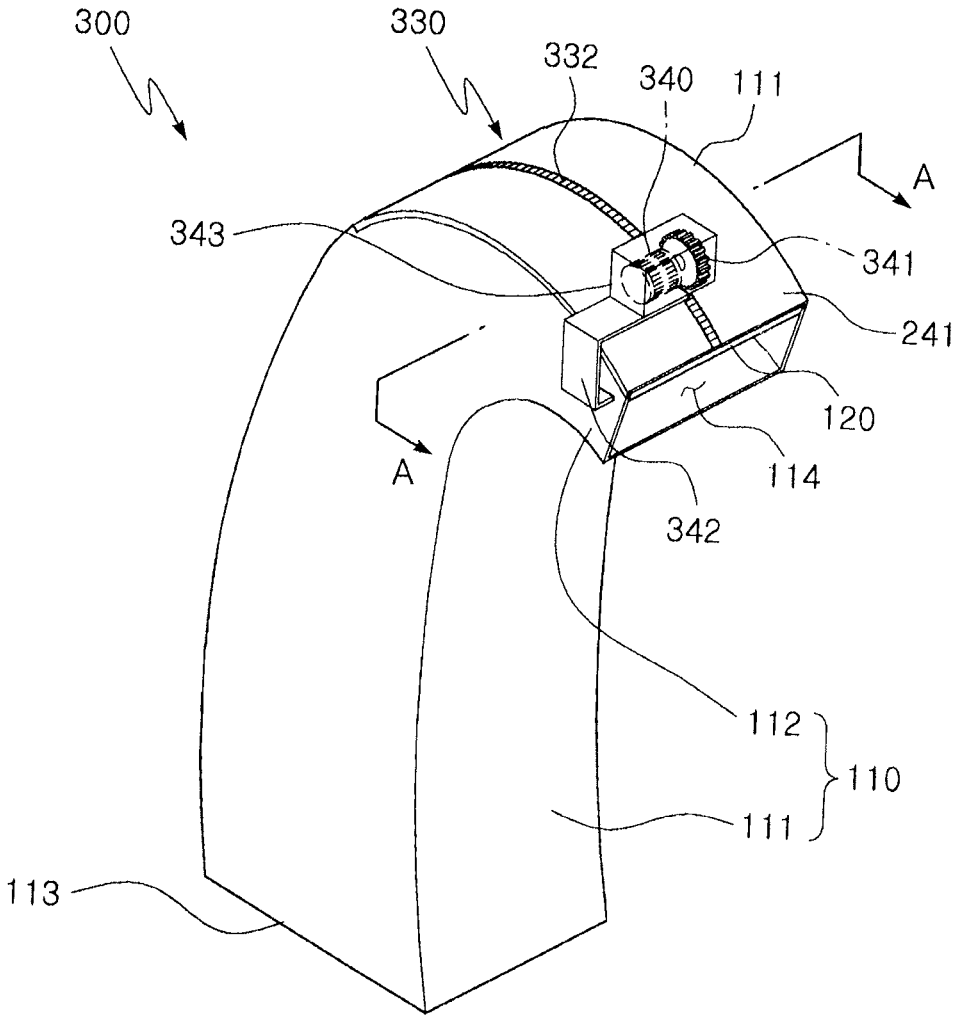
FIG. 9 is a perspective view showing an entire discharge pipe for a snow blower according to a third embodiment of the present invention.

As another embodiment, as shown in FIGS. 9 to 11, the second body 112 is provided with an approximately C-shaped bracket 342 on one side thereof, and a driving motor 340, to an end of a rotational shaft of which a driving gear 241 is coupled, is fixedly installed on the bracket 342. A driven gear 332 is formed in an upper surface of the cover plate 330 so as to be able to mesh with the driving gear 341. As a result, when the driving motor 340 is powered, a driving force is transmitted to the driven gear 332 meshed with the driving gear 340 by forward or backward rotation of the driving gear 341. Thereby, the cover plate 330 slides along the guide grooves 112*e* formed in the opposite sidewalls 112*b* and 112*c*. Here, a separate protection case 343 covering the driving motor 340 and the driven gear 332 may be provided so as to be able to prevent the driving motor 340 fixedly installed on the bracket 342 and the driven gear 332 from being exposed to the outside.

Here, the driving motor 240 or 340 is electrically connected on the side of the snow blower, on which the discharge pipe 200 or 300 is mounted, so as to be able to be supplied with power. A separate switch is provided halfway so as to be able to control forward or backward rotation of the driving motor 240 or 340 and on/off switching of the supply of power. This electrical connection relationship is known, and so a detailed description will be omitted.

Even when the driving motor 240 or 340 is provided to electrically control the sliding of the cover plate 230 or 330, a handle is provided to the upper surface of the cover plate 230 or 330. Thus, when the electrical driving is difficult, it is preferable that the worker directly grasps the handle to be able to slide the cover plate 230 or 330.

According to the present invention as described above, the cover plate whose lower surface is in contact with the scraper is movably coupled on the side of the outlet of the discharge pipe. Thereby, although the snow discharged to the outside through the inside is piled up on the lower surface of the cover plate, the cover plate is displaced to be able to easily remove the covered snow with the scraper. Thus, the efficiency of the snow-removing work can be increased.

The specific embodiment of the present invention has been described with reference to the drawings. However, the present invention is not limited to the specific structure as described above. Those having ordinary skill in the art will appreciate that modifications or alterations will be made within the scope of the technical spirit disclosed in the claims. However, all equivalents, modifications, and substitutions based on simple design modifications or corrections are to be considered within the scope of the invention.

The invention claimed is:

1. A discharge pipe for a snow blower, which is mounted on the snow blower and discharges internally introduced snow to an outside, comprising:

a box-shaped body having an inlet and an outlet through which the snow is introduced and discharged and an opening in an upper portion thereof at a side of the outlet;

a cover plate having a predetermined area and slidably coupled to the body so as to cover the opening;

a scraper having a shape of a bar having a predetermined length and disposed on the side of the outlet so as to come into line or surface contact with a lower surface of the cover plate;

wherein, when the cover plate slides toward the outlet, the snow covered on the lower surface of the cover plate is removed by the scraper; and wherein the cover plate includes hooks extending downwards from opposite ends thereof to a predetermined length, and the body includes guide grooves cut in a direction parallel to a discharging direction of the snow to a predetermined depth, so that the hooks slide along the guide grooves.

2. The discharge pipe for the snow blower according to claim 1, wherein the cover plate further includes a handle on an upper surface thereof.

3. The discharge pipe for the snow blower according to claim 1, wherein: the body includes at least one driving motor, to a rotational shaft of which a driving gear is coupled, on the side of the outlet; and the cover plate includes a driven gear, with which the driving gear is meshed, on the lower surface thereof.

4. The discharge pipe for the snow blower according to claim 1, wherein: the body includes at least one driving motor, to a rotational shaft of which a driving gear is coupled, fixedly supported on one side thereof via a bracket; and the cover plate includes a driven gear, with which the driving gear is meshed, on an upper surface thereof.

* * * * *